US008604988B2

(12) United States Patent
Desclos et al.

(10) Patent No.: US 8,604,988 B2
(45) Date of Patent: Dec. 10, 2013

(54) MULTI-FUNCTION ARRAY FOR ACCESS POINT AND MOBILE WIRELESS SYSTEMS

(75) Inventors: Laurent Desclos, San Diego, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 13/612,833

(22) Filed: Sep. 13, 2012

(65) Prior Publication Data

US 2013/0099987 A1 Apr. 25, 2013

Related U.S. Application Data

(63) Continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402.

(60) Provisional application No. 61/533,553, filed on Sep. 12, 2011.

(51) Int. Cl.
*H01Q 9/00* (2006.01)

(52) U.S. Cl.
USPC ..... 343/745; 343/725; 343/813; 343/815

(58) Field of Classification Search
USPC ..... 343/700, 722, 725, 745, 750, 853, 813, 343/815
See application file for complete search history.

(56) References Cited

U.S. PATENT DOCUMENTS

| | | | | |
|---|---|---|---|---|
| 6,392,603 | B1 * | 5/2002 | Kurz et al. | 343/702 |
| 6,781,553 | B2 * | 8/2004 | Iguchi et al. | 343/725 |
| 7,375,694 | B2 * | 5/2008 | Jung et al. | 343/745 |
| 7,403,165 | B2 * | 7/2008 | Qi et al. | 343/702 |
| 7,821,467 | B2 * | 10/2010 | Sugiyama | 343/745 |
| 7,843,397 | B2 * | 11/2010 | Boyle | 343/745 |
| 7,969,361 | B2 * | 6/2011 | Castaneda et al. | 343/700 MS |

* cited by examiner

*Primary Examiner* — Tho G Phan
(74) *Attorney, Agent, or Firm* — Coastal Patent Law Group; Joshua S. Schoonover, P.C.

(57) ABSTRACT

A multi-function array is described where several communication system functions are realized using the same antenna architecture. An array of antenna elements where each antenna element can generate multiple radiation patterns is described; the multiple radiation patterns from each antenna element provides increased capability and flexibility in generating a phased array, a MIMO antenna system, a receive diversity antenna system, as well as direction finding feature by way of an interferometer function provided by one or multiple elements. The small volume attributes of the antenna elements populating the array lend this technique to mobile wireless devices as well as access points.

7 Claims, 13 Drawing Sheets

Practical Realization of Modal Array

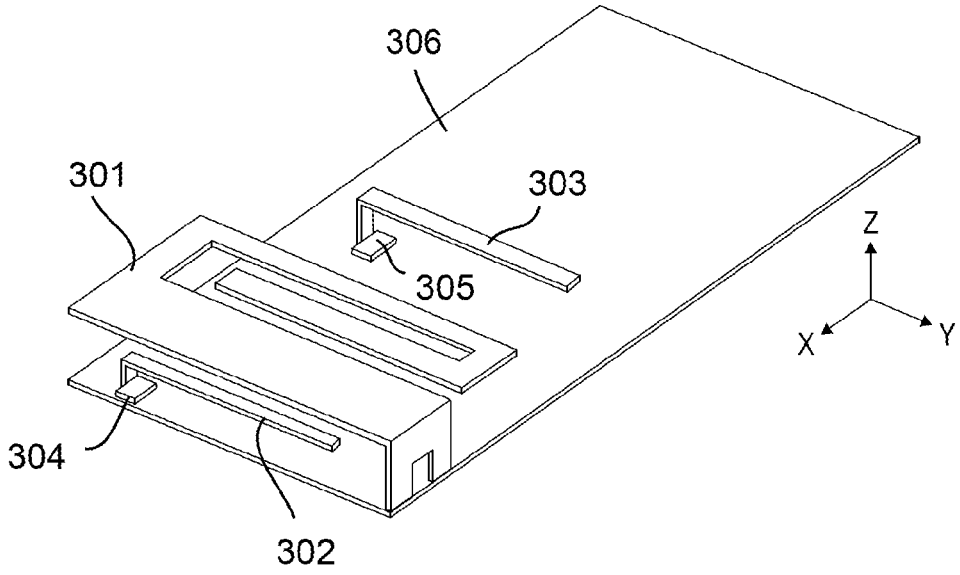
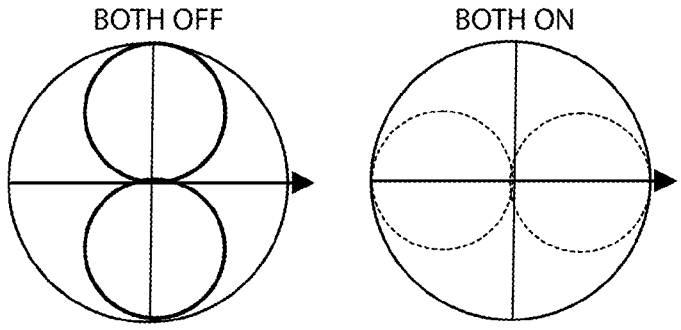
TWO DIFFERENT RADIATION PATTERNS AT THE SAME FREQUENCY
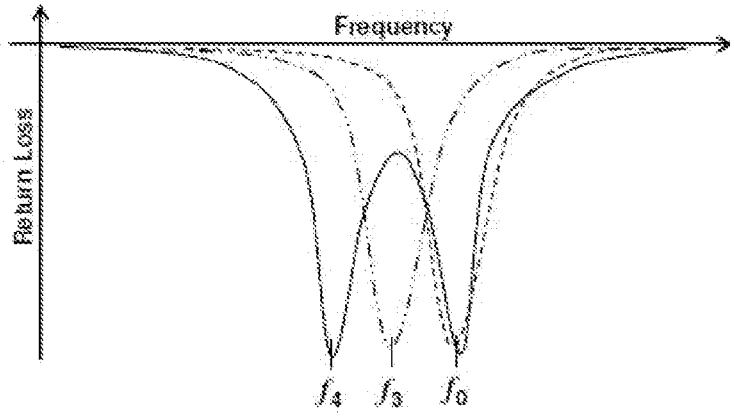
FIG.3
(PRIOR ART)

Receive Diversity Configuration
3 Antenna Elements

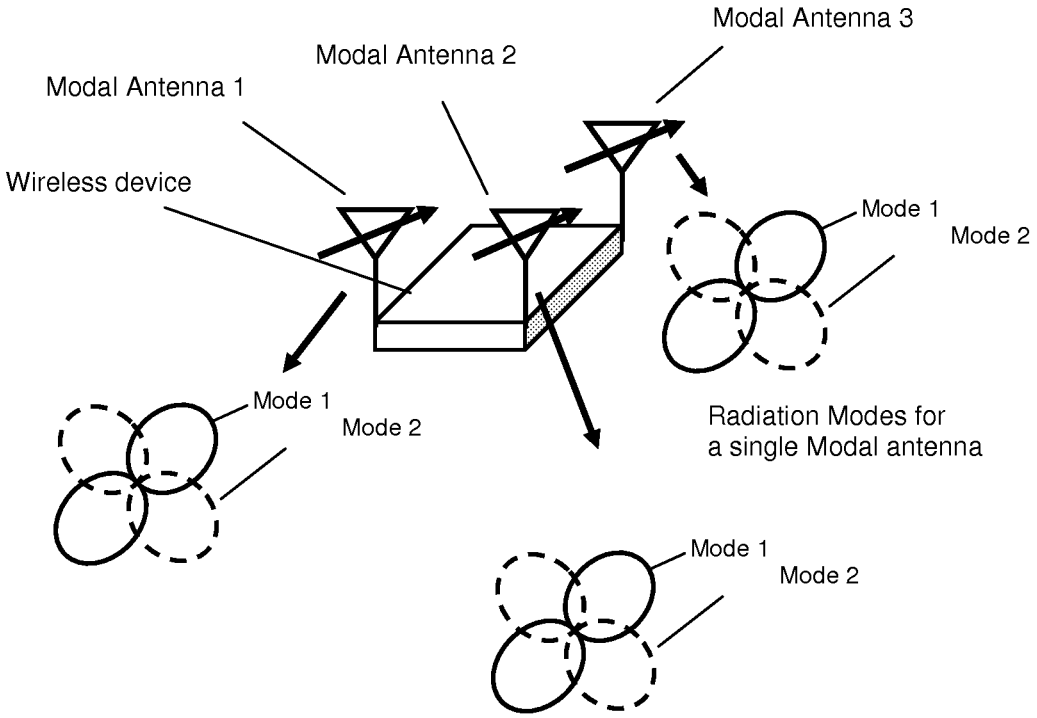

28 unique radiation pattern pairings for 2 antenna receive diversity scheme using 3 Modal antennas with 2 Modes each

| Main antenna | Diversity antenna |
|---|---|
| Antenna 1, Mode 1 | antenna 2, Mode 1 |
| Antenna 1, Mode 2 | antenna 2, Mode 1 |
| Antenna 1, Mode 1 | antenna 2, Mode 2 |
| Antenna 1, Mode 2 | antenna 2, Mode 2 |
| Antenna 1, Mode 1 | antenna 2, Mode 1 combined with antenna 3, Mode 1 |
| Antenna 1, Mode 1 | antenna 2, Mode 1 combined with antenna 3, Mode 2 |
| … … | … … … |
| Antenna 3, Mode 2 | antenna 1, Mode 2 combined with antenna 2, Mode 2 |

Fig.6

Receive Diversity Configuration
M Antenna Elements

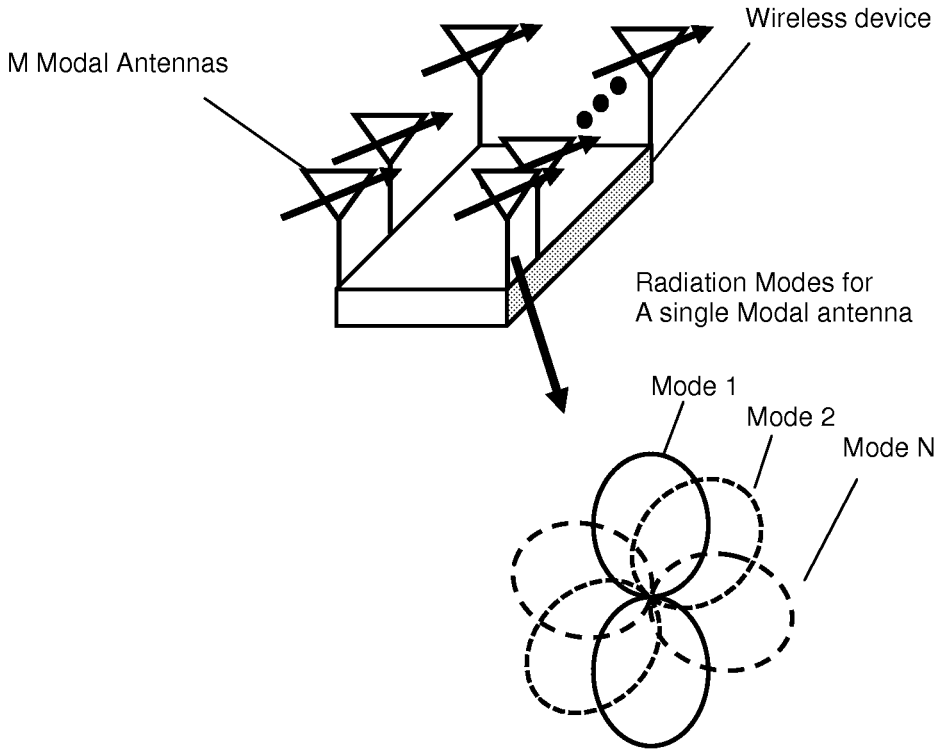

A plurality of unique radiation pattern pairings for 2 antenna receive diversity scheme using M Modal antennas with N Modes each

| Main antenna | Diversity antenna |
|---|---|
| Antenna 1, Mode 1 | antenna 2, Mode 1 |
| Antenna 1, Mode 1 | antenna 2, Mode 2 |
| … … | … … |
| Antenna 1, Mode 1 | antenna 2, Mode 1 combined with antenna 3, Mode 1 |
| Antenna 1, Mode 1 | antenna 2, Mode 1 combined with antenna 3, Mode 2 |
| … … | … … … |
| Antenna M, Mode N | antenna M-1, Mode N combined with antenna M-2, Mode N |

Fig.7

3 Antenna MIMO Configuration

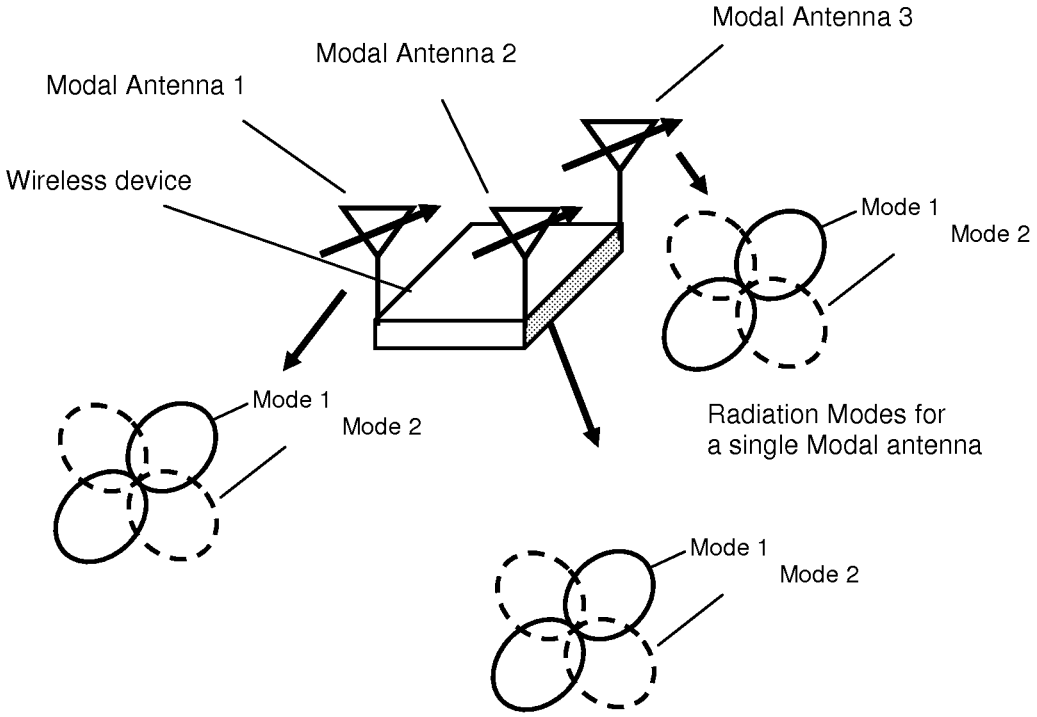

28 unique radiation pattern pairings for 2 antenna MIMO scheme using 3 Modal antennas with 2 Modes each

| **Antenna 1** | **Antenna 2** |
|---|---|
| Antenna 1, Mode 1 | antenna 2, Mode 1 |
| Antenna 1, Mode 2 | antenna 2, Mode 1 |
| Antenna 1, Mode 1 | antenna 2, Mode 2 |
| Antenna 1, Mode 2 | antenna 2, Mode 2 |
| Antenna 1, Mode 1 | antenna 2, Mode 1 combined with antenna 3, Mode 1 |
| Antenna 1, Mode 1 | antenna 2, Mode 1 combined with antenna 3, Mode 2 |
| … … | … … … |
| Antenna 3, Mode 2 | antenna 1, Mode 2 combined with antenna 2, Mode 2 |

Fig.8

M Antenna MIMO Configuration

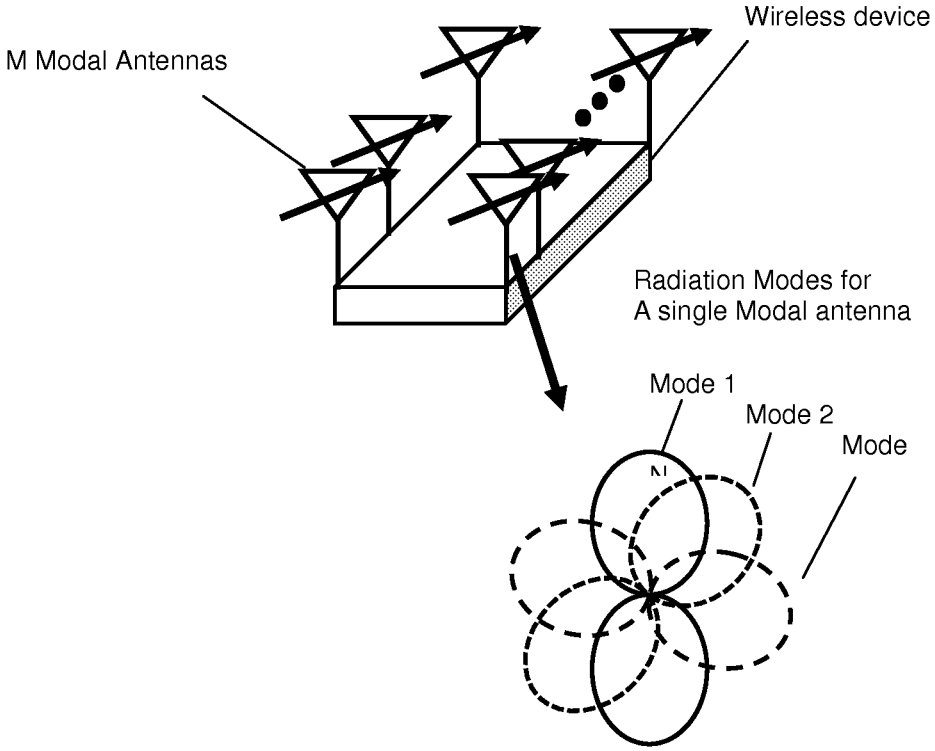

A plurality of unique radiation pattern combinations for A x B antenna MIMO scheme using M Modal antennas with N Modes each

| Antenna 1 | Antenna 2 |
|---|---|
| Antenna 1, Mode 1 | antenna 2, Mode 1 |
| Antenna 1, Mode 2 | antenna 2, Mode 1 |
| Antenna 1, Mode 1 | antenna 2, Mode 2 |
| Antenna 1, Mode 2 | antenna 2, Mode 2 |
| Antenna 1, Mode 1 | antenna 2, Mode 1 combined with antenna 3, Mode 1 |
| Antenna 1, Mode 1 | antenna 2, Mode 1 combined with antenna 3, Mode 2 |
| … … | … … … |
| Antenna 3, Mode 2 | antenna 1, Mode 2 combined with antenna 2, Mode 2 |

Fig.9

Amplitude and phase data stored in processor and accessed to determine angle of arrival (AOA)

Combining Circuit
- Combining circuit provides single beam antennas for MIMO and Rx diversity
- Separate array port
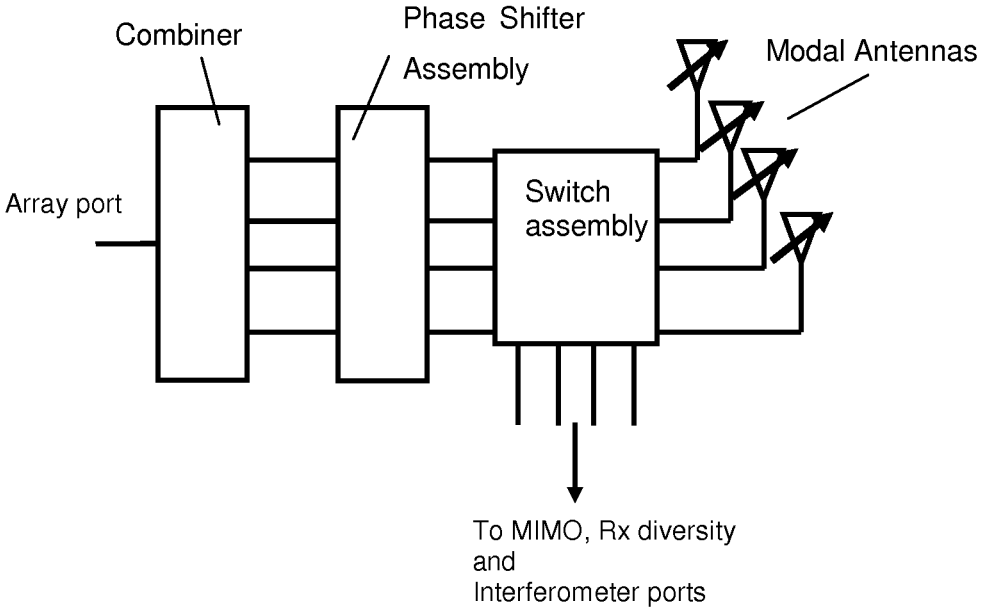
- Combining circuit provides arrayed beam antennas for MIMO and Rx diversity
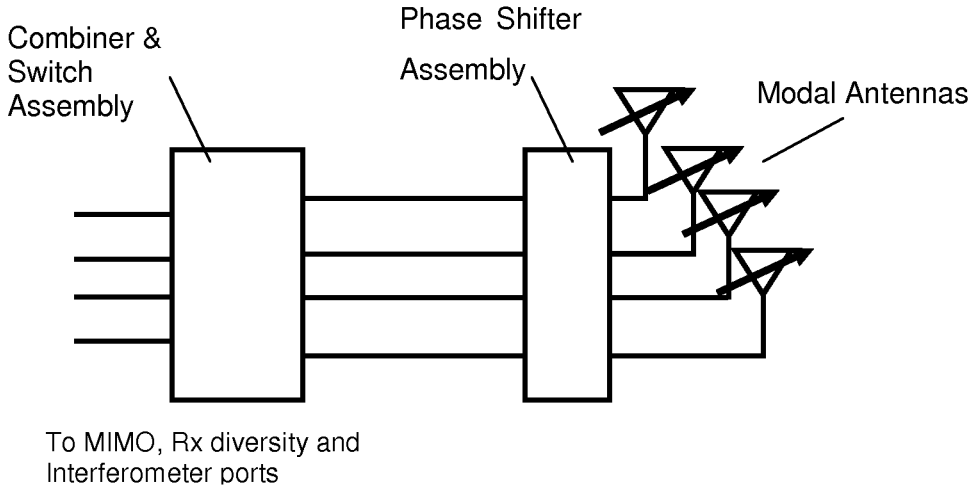
Fig.11

Combining Circuit

- Combining circuit provides the ability to mix single element and combined elements into N port transceiver

Practical Realization of Modal Array
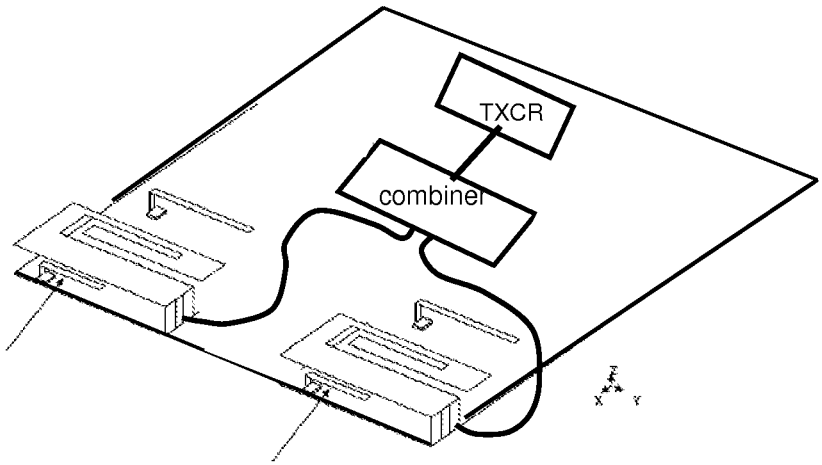
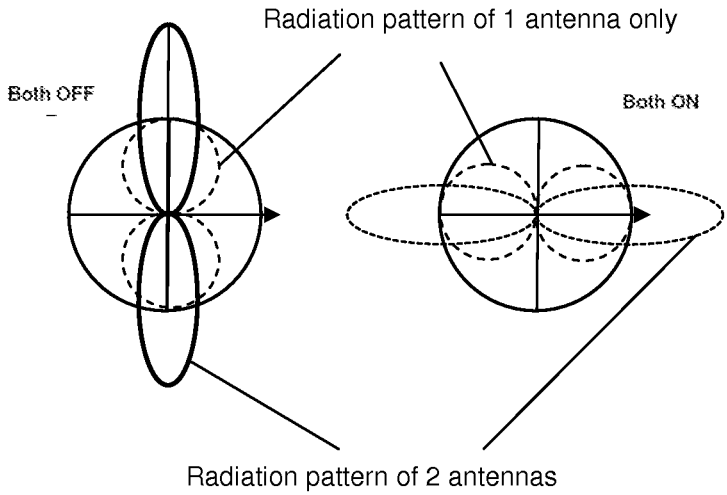
Fig.13

MULTI-FUNCTION ARRAY FOR ACCESS POINT AND MOBILE WIRELESS SYSTEMS

CROSS-REFERENCE TO RELATED APPLICATIONS

This application is a continuation in part (CIP) of U.S. patent application Ser. No. 13/029,564, filed Feb. 17, 2011 now U.S. Pat. No. 8,362,962, titled "ANTENNA AND METHOD FOR STEERING ANTENNA BEAM DIRECTION", which is a CON of U.S. patent application Ser. No. 12/043,090, filed Mar. 5, 2008, titled "ANTENNA AND METHOD FOR STEERING ANTENNA BEAM DIRECTION", now U.S. Pat. No. 7,911,402, issued Mar. 22, 2011; and this application claims benefit of priority to U.S. Provisional Application Ser. No. 61/533,553, filed Sep. 12, 2011, titled "MULTI-FUNCTION ARRAY FOR ACCESS POINT AND MOBILE WIRELESS SYSTEMS";

the contents of each of which are hereby incorporated by reference.

BACKGROUND OF THE INVENTION

1. Field of the Invention

This invention relates to wireless communications; and more particularly to antenna arrays for integration with access points, wireless mobile devices, and communication systems, to service a multitude of functions including phased arrays, multiple input multiple output (MIMO), receive diversity, and direction finding.

2. Related Art

There is a current need for improved connectivity at cellular and data transmission bands for mobile wireless devices and access points to accommodate the increasing demand for data rates for mobile wireless systems. Improved antenna performance, such as increased efficiency, will translate into increased data rates. Another effective method of improving data rates is to increase the signal to interference plus noise ratio (SINR); the antenna system can significantly improve SINR by increasing directivity. Directivity can be improved by arraying multiple antennas together to form an array. This arraying of antennas increases the effective aperture of the antenna resulting in a more directional beam. The directional antenna radiation pattern or beam can be utilized to direct the signal to the desired direction of communication, or conversely point the antenna radiation pattern in the direction for desired reception. As the antenna radiation pattern narrows, increased transmission and reception in the direction of the main beam is realized, while decreased transmission and reception in other directions is reduced. A resulting improvement in SINR from this narrowing of the antenna beam is realized.

An additional benefit from arraying antenna elements together is the ability to change radiation pattern shape of the array by changing the number of antennas that are combined, or by introducing amplitude and or phase shifts in the feed lines used to connect and combine the various antenna elements together. Changing the radiation pattern of the antenna system during communications provides the ability to improve the communication link quality by optimizing the array pattern; this optimization can take the form of fine tuning the direction of the maxima of the radiation pattern, or can be implemented by increasing the number of antennas connected to increase the directivity of the antenna system. An additional benefit from modifying the radiation pattern can be realized by forming a null in the array pattern and then steering the null in the direction of an interfering source. This will result in improved SINR.

Recent developments in the art have provided for steering of antenna radiation characteristics as is described in commonly owned U.S. Pat. No. 7,911,402 titled "ANTENNA AND METHOD FOR STEERING ANTENNA BEAM DIRECTION", and issued Mar. 22, 2011; the contents of which are hereby incorporated by reference.

More recently, "beam steering antennas" have evolved toward applications for correcting situations where a wireless device may enter a location having little to no signal reception, otherwise known in the art as a "null" or "null field". When the device enters a null, the beam steering mechanism activates to steer antenna radiation characteristics into a useable state or mode. More specifically, these Modal antennas are adapted with two or more modes of operation, wherein each mode exhibits unique radiation characteristics across the uniform antenna structure.

BRIEF DESCRIPTION OF THE DRAWINGS

FIG. 3 illustrates a modal antenna, wherein an Isolated Magnetic Dipole (IMD) antenna element is shown with two parasitic elements, a first parasitic positioned within the volume of the IMD antenna which is used for frequency adjustment, and the second parasitic which is offset from the IMD antenna and is used to alter the current mode on the IMD antenna.

FIG. 6 illustrates a three element array of Modal antennas in a wireless device.

FIG. 7 illustrates an M element array of Modal antennas in a wireless device.

FIG. 8 illustrates a three element array of Modal antennas in a wireless device.

FIG. 9 illustrates an M element array of Modal antennas in a wireless device.

FIG. 11 illustrates two basic combining circuit topologies to connect multiple Modal antennas to a transceiver port.

FIG. 13 illustrates a practical realization of a two element Modal array.

DETAILED DESCRIPTION OF THE PREFERRED EMBODIMENTS

Figure 1A:
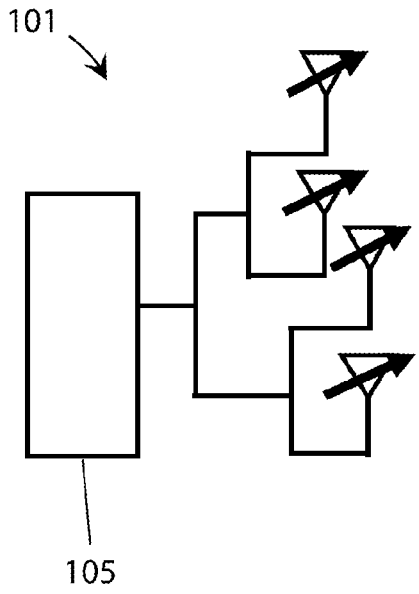
FIG.1A (PRIOR ART)
FIGS. 1(A-D) illustrate typical antenna connection topologies for four different antenna systems: MIMO, array, receive diversity, and direction finding
Figure 1B:
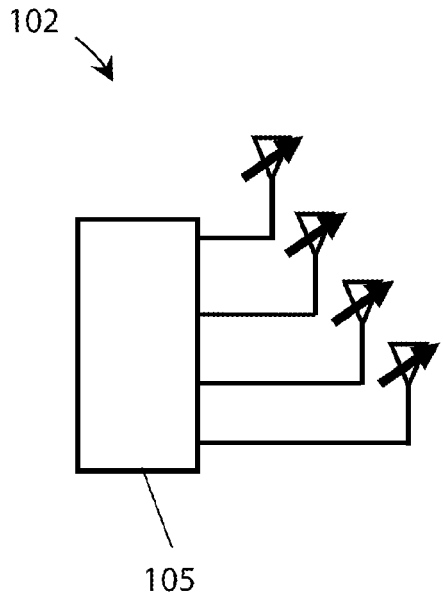
FIG.1B (PRIOR ART)
Figure 1C:
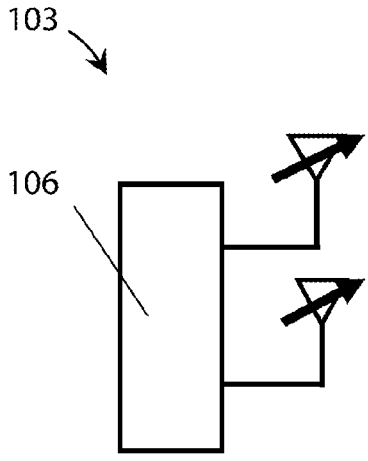
FIG.1C (PRIOR ART)
Figure 1D:
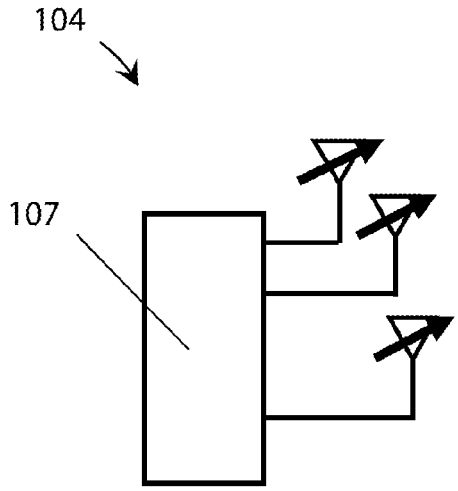
FIG.1D (PRIOR ART)

This patent describes an antenna system comprising an array of antenna elements, wherein one or more of the antenna elements is adapted to generate multiple unique radiation patterns. The Modal antenna described in U.S. Pat. No. 7,911,402 titled "ANTENNA AND METHOD FOR STEERING ANTENNA BEAM DIRECTION" is an example of an antenna adapted to generate several unique radiation patterns from a single antenna structure. By combining one or several Modal antennas into an array configuration several novel features come to light. For example, an array of modal antennas provides the ability to increase the number of unique radiation beams that can be generated by the array. The combining circuit or "feed circuit" of an array along with the number of antenna elements populating the array will define the number of unique beams that can be generated. The introduction of Modal antennas which possess N unique radiation modes will significantly increase the number of unique radiation beams.

In one embodiment of the present invention, the array can be configured to provide a unique receive diversity solution where one or both receive radiation patterns are generated by combining radiation patterns from multiple arrayed Modal antennas. This additional flexibility of arraying elements together to form receive diversity patterns provides reduced correlation and increased isolation between pairs of elements. Using the array to steer the radiation pattern of one or both antennas in the receive diversity scheme provides the ability to reduce the time one or both antennas are situated in a "null" or reduced signal level region. Steering the radiation pattern will point the array beam in a direction of impinging radiation being scattered into the beam to reduce or eliminate the null region.

In another embodiment of the present invention, the array can be configured to provide multiple antenna patterns for a multiple input multiple output (MIMO) application where one or more radiation patterns are generated by combining radiation patterns from multiple arrayed Modal antennas. The use of and combination of Modal antennas to form combined radiation patterns can be used to improve MIMO antenna system performance by selecting modes of specific Modal antennas and combining or arraying modal antennas to reduce a correlation coefficient between the antennas in the MIMO system, as well as increase isolation between pairs of antennas in the system. Improved signal to interference plus noise ratio (SINR) per channel will result when beam forming is provided for one or more MIMO antennas.

In another embodiment, two or more antennas in the array can be used to generate an interferometer for determining angle of arrival (AOA) of incoming signals. The receive phase from two or more antennas in the system can be analyzed to discern AOA, wherein additional beams are available for use due to the use of Modal antennas in the antenna system, along with the ability of combining two or more antennas in the system in an array for one or more of the elements required for the interferometer.

Now turning to the drawings, FIGS. 1(A-D) describe current and future requirements for antenna systems in communication devices. A number of current and/or future requirements from antenna systems within communications devices include: high directivity beams for high data rate communications; receive diversity function; MIMO function; interference suppression capability; and direction finding capability. Current solutions describe antenna systems that can typically only address one or two of the 4 required or desired antenna functions. Typical antenna connection topologies are shown for four different antenna systems, including: multi-element array 101 coupled to transceiver 105 for smart antenna function as illustrated in FIG. 1A; multi-element MIMO system 102 having multiple elements for MIMO function coupled to transceiver 105 as illustrated in FIG. 1B; a two-antenna system 103 coupled to receiver 106 for receive diversity function as illustrated in FIG. 1C; and a multiple element antenna system 104 having multiple elements for interference suppression coupled to interferometer 107 as illustrated in FIG. 1D. More functionality per antenna element is needed to overcome current limitations.

Figure 2:
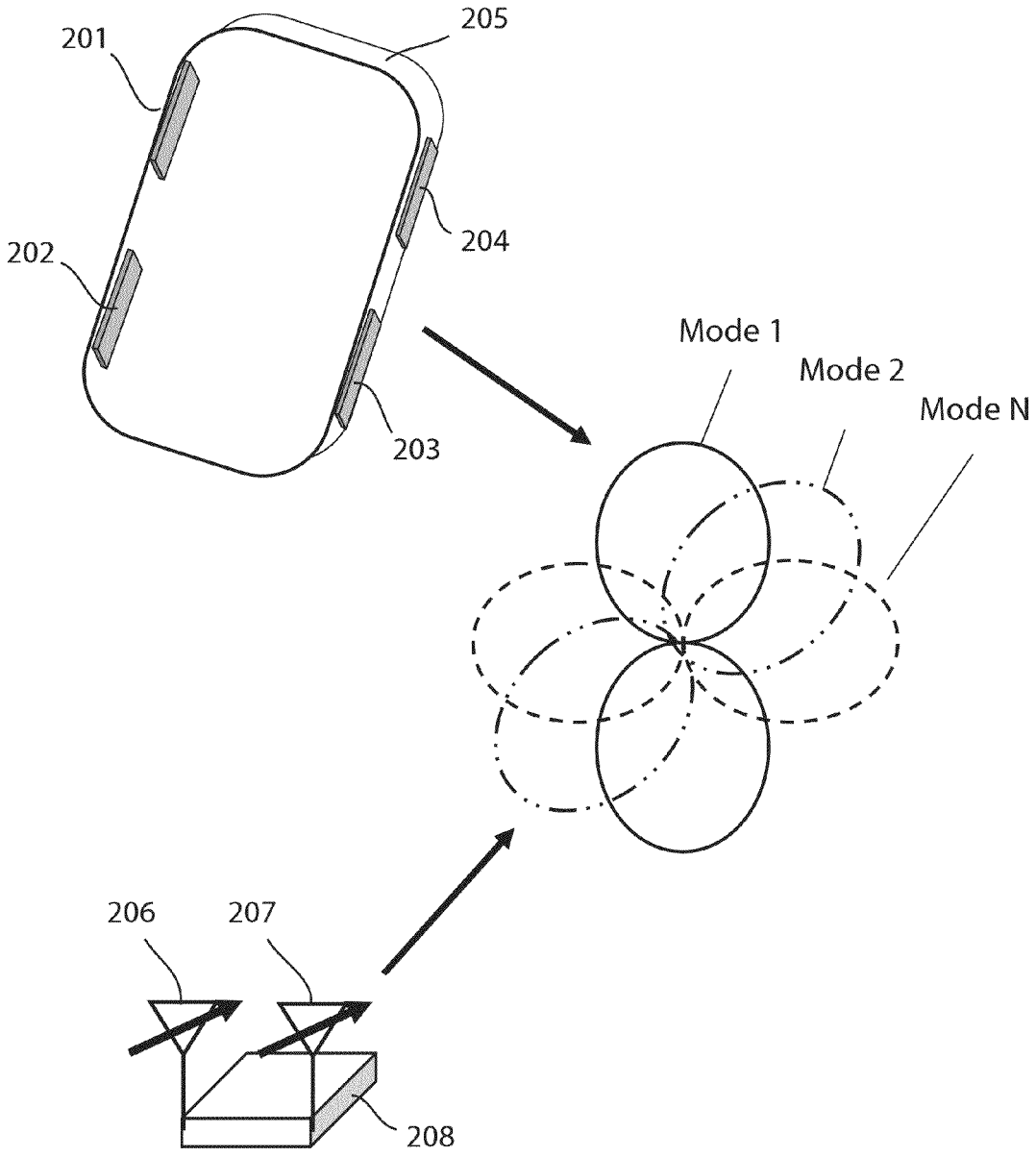
FIG. 2 illustrates an array of Modal antenna elements.

FIG. 2 illustrates an array of Modal antenna elements. Four Modal antennas 210; 202; 203; 204, respectively, are shown within a mobile communication device 205 in a mobile wireless device configuration; alternately the Modal antennas can be integrated into fixed communication devices such as access points, with an access point 208 with two Modal antennas 206; 207, respectively, being shown. Each Modal antenna can generate multiple radiation patterns, with up to N modes as shown in tFIG. 2. An antenna array of modal elements as shown in FIG. 2 provides a number of advantages. For example, an antenna system with "M" modal antennas where each of the "M" modal antennas can produce up to "N" modes per antenna provides: $M^N$ array beams for phased array function; multiple mode combinations for receive diversity function; "M" element MIMO antenna system with variable patterns' and "M" element interferometer for direction finding function.

FIG. 3 illustrates the configuration and operation of a Modal antenna described in the '402 patent. An Isolated Magnetic Dipole (IMD) antenna 301 is positioned over a circuit board 306 to form an antenna volume therebetween; the IMD antenna is shown with two parasitics, a first parasitic element 302 positioned within the volume of the IMD antenna which is used for frequency adjustment, and a second parasitic element 303 which is offset from the IMD antenna volume and is used to alter the current mode on the IMD antenna. Each of the parasitic elements are coupled to active tuning elements 304; 305, respectively, for connecting/disconnecting the parasitics with the ground plain in this example. When both the first and second parasitics are disconnected from the ground plane (both in "OFF" state) a specific radiation pattern is generated. When both parasitics are connected to the ground plane (both in "ON" state) a second unique radiation pattern is generated. In this regard, a second parasitic element is used to tune the antenna frequency to $f_3$ when shorted to ground. Now, when the first parasitic is shorted to ground the resonances occur at $f_4$ and $f_0$ (same frequency as with both parasitic open).

Figure 4:
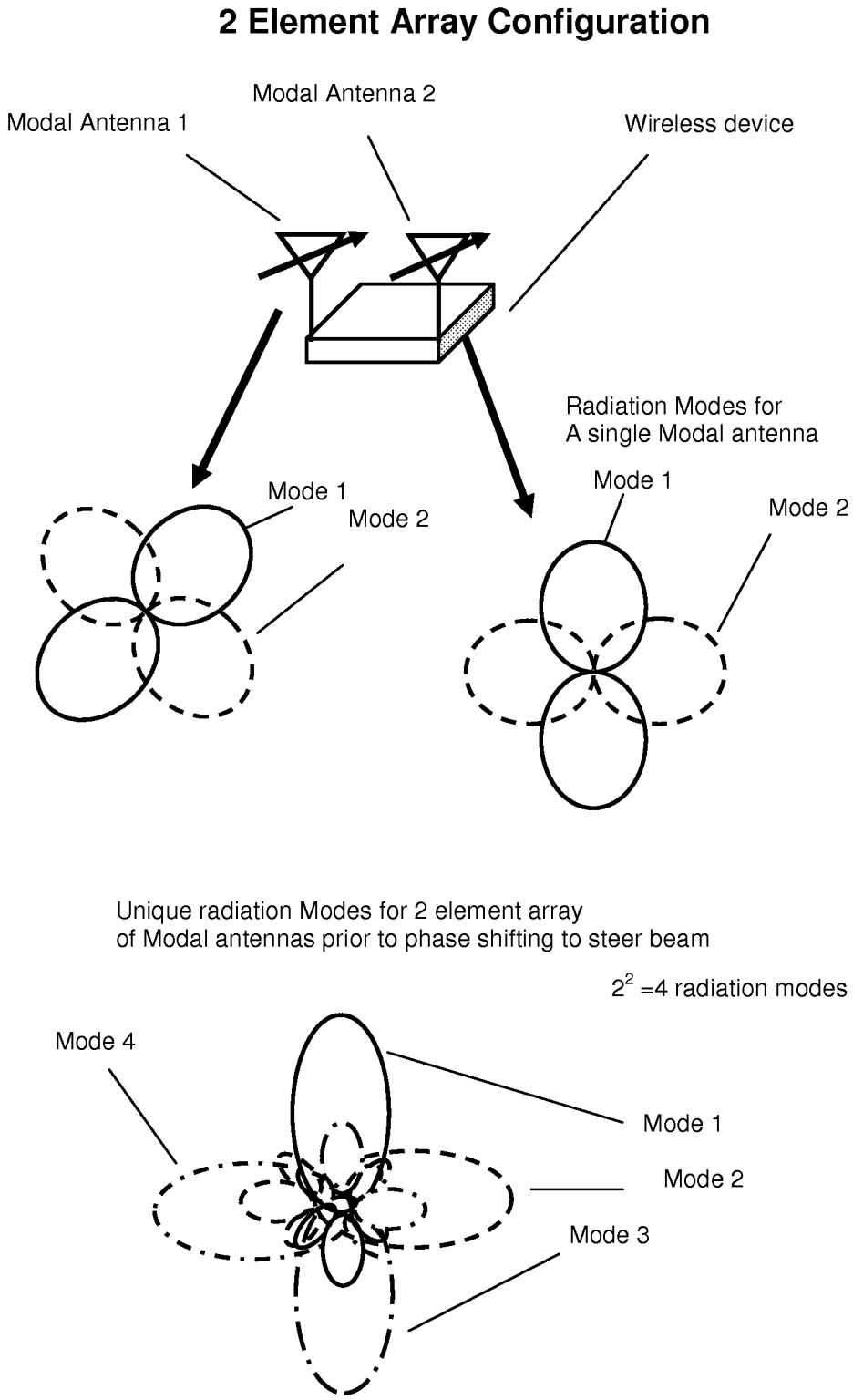
FIG. 4 illustrates a two element array of Modal antennas in a wireless device.

FIG. 4 illustrates a two element array of Modal antennas in a wireless device. Each Modal antenna has two unique radiation patterns. A combination of the two Modal antennas in the array will generate four unique radiation patterns or modes. Additional radiation patterns can be generated using the array by applying phase shifts to the various antenna elements to steer the array radiation pattern.

Figure 5:
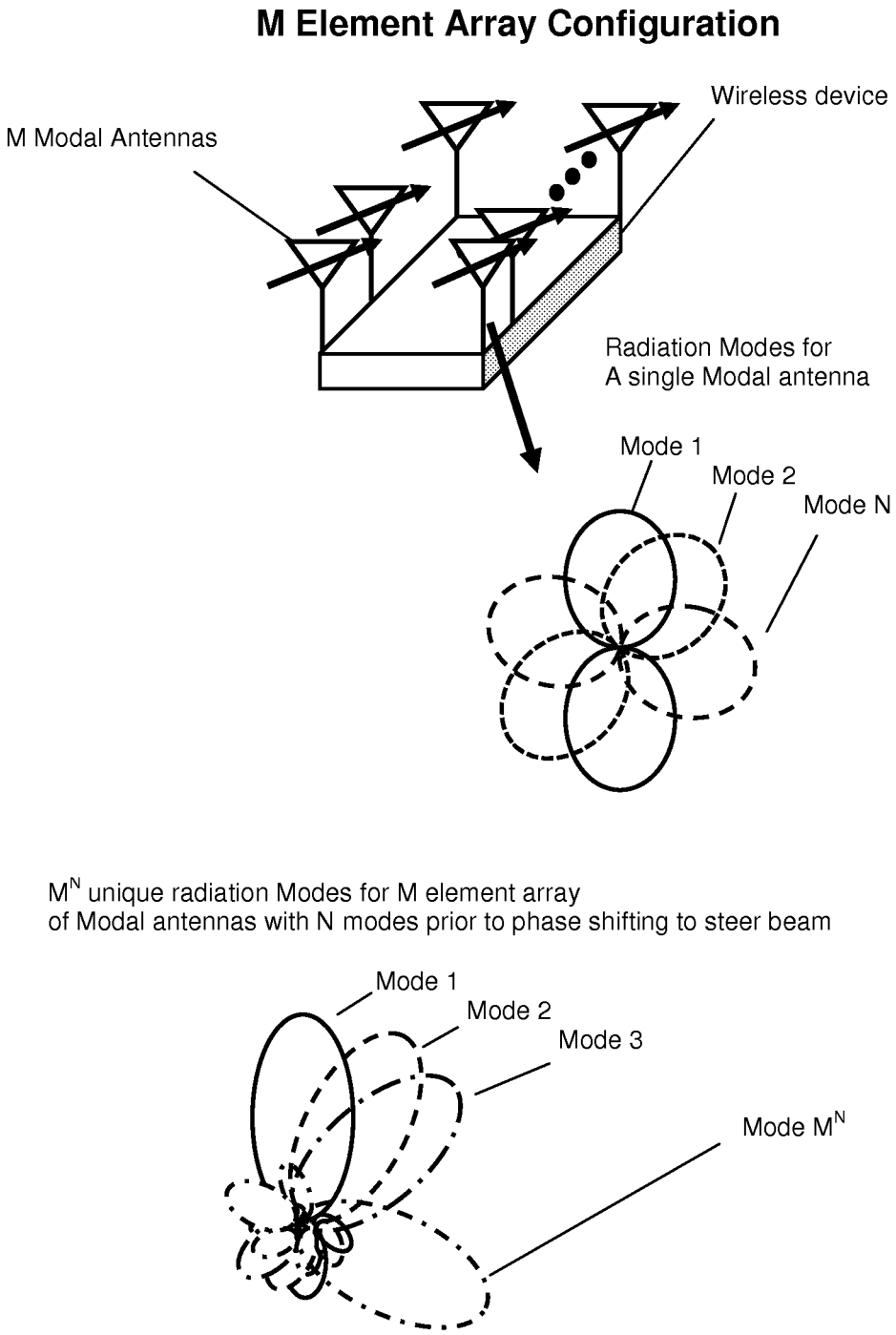
FIG. 5 illustrates an M element array of Modal antennas in a wireless device.

FIG. 5 illustrates an M element array of Modal antennas in a wireless device. Each Modal antenna has N unique radiation patterns or modes. A combination of the M Modal antennas in the array will generate MN unique radiation patterns or modes. Additional radiation patterns can be generated using the array by applying phase shifts to the various antenna elements to steer the array radiation pattern.

FIG. 6 illustrates a three element array of Modal antennas in a wireless device. Each Modal antenna has two unique radiation patterns. 28 combinations of pairs of radiation patterns can be generated to provide a two antenna receive diversity function. For the 28 combinations of patterns some patterns are from single antenna elements and some are generated by combining two antennas together into a two element array.

FIG. 7 illustrates an M element array of Modal antennas in a wireless device. Each Modal antenna has N unique radiation patterns. A plurality of combinations of pairs of radiation patterns can be generated to provide a two antenna receive diversity function. For the plurality of combinations of patterns some patterns are from single antenna elements and some are generated by combining two antennas together into a two element array.

FIG. 8 illustrates a three element array of Modal antennas in a wireless device. Each Modal antenna has two unique radiation patterns. Twenty eight (28) combinations of pairs of radiation patterns can be generated to provide a two antenna MIMO (Multiple Input Multiple Output) function. For the 28 combinations of patterns some patterns are from single antenna elements and some are generated by combining two antennas together into a two element array.

FIG. 9 illustrates an M element array of Modal antennas in a wireless device. Each Modal antenna has N unique radiation patterns. A plurality of combinations of radiation patterns can be generated to provide a multi-antenna MIMO (Multiple Input Multiple Output) function. For the plurality of combinations of patterns some patterns are from single antenna elements and some are generated by combining two or more antennas together into a multi-element array.

Figure 10:
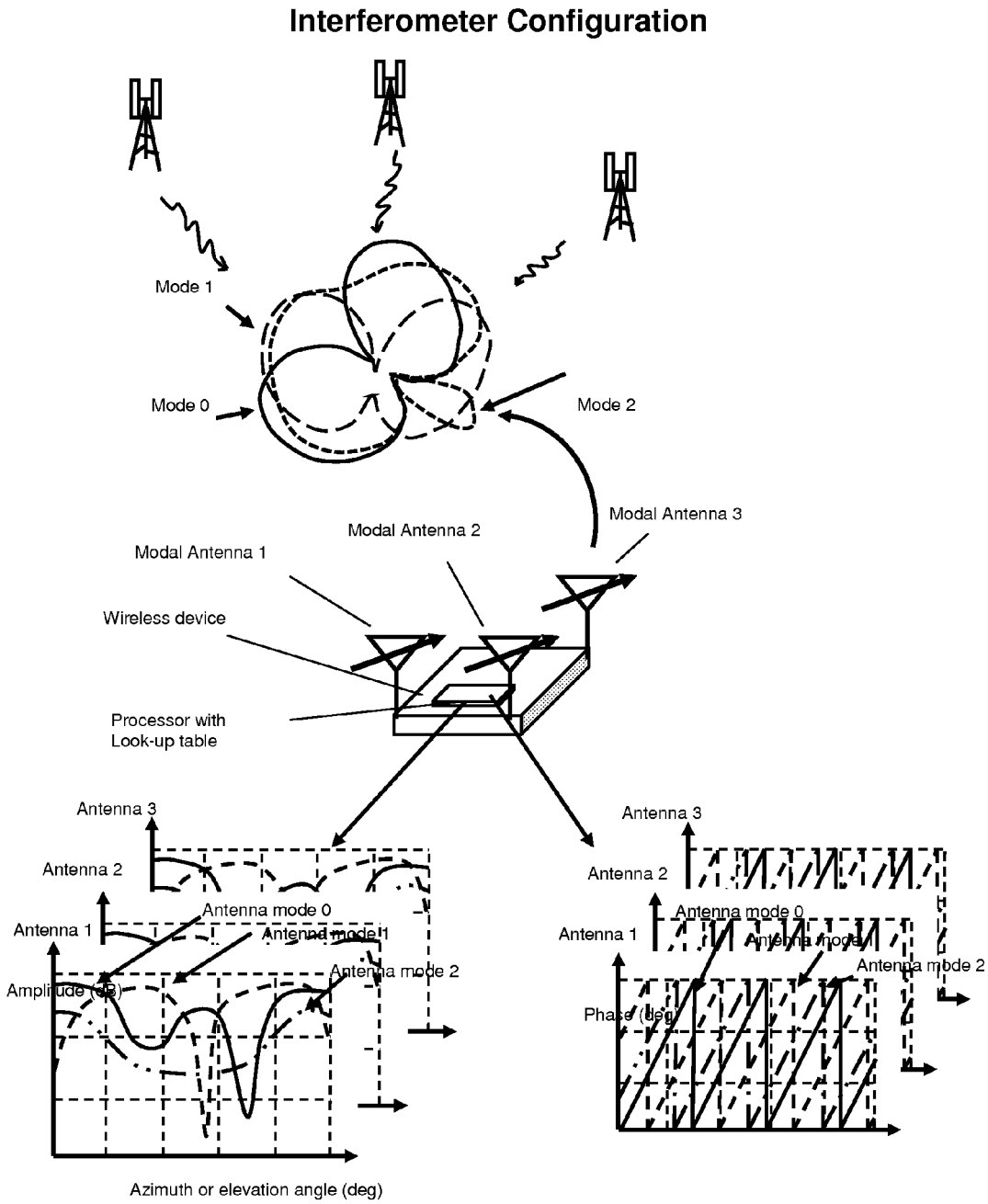
FIG. 10 illustrates a three element array of Modal antennas in a wireless device.

FIG. 10 illustrates a three element array of Modal antennas in a wireless device. Each Modal antenna has three unique radiation patterns or modes. The amplitude and phase data for each mode for each antenna is stored in a processor and can be retrieved and used to determine the angle of arrival (AOA) of an incoming RF signal. Standard processing of received phase to discern angle of arrival can be performed. The amplitude characteristics of the radiation patterns can be used to improve accuracy of the phase processing.

FIG. 11 illustrates two basic combining circuit topologies to connect multiple Modal antennas to a transceiver port. One topology shows a switch assembly between the antenna elements and the combiner to allow for individual antenna elements to be accessed for a MIMO, receive diversity, or interferometer function. A second topology shows the antenna elements connected to a phase shifter assembly and then connected to a combiner/switch assembly.

Figure 12:
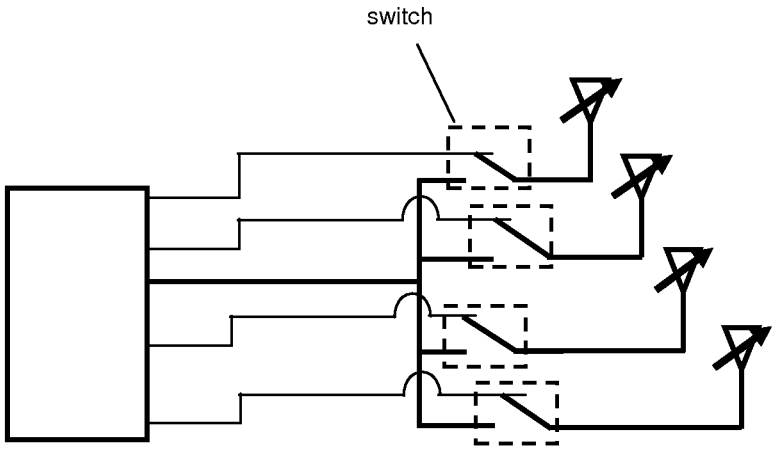
FIG. 12 illustrates a combining circuit configured to allow the four individual antenna elements to be accessed in the transceiver or for two, three, or four of the antenna elements can be combined for use by the transceiver.

FIG. 12 illustrates a combining circuit configured to allow the four individual antenna elements to be accessed in the transceiver or for two, three, or four of the antenna elements can be combined for use by the transceiver.

FIG. 13 illustrates a practical realization of a two element Modal array. Two IMD antennas along with pairs of parasitics elements for frequency adjustment and mode altering are included. The two IMD antennas are connected to a combining circuit which in turn is connected to the port of a transceiver.

In one embodiment, an antenna system comprises: two or more antennas; and a combining circuit. One or more of the antennas comprises a modal antenna capable of generating two or more unique radiation patterns. The one or more modal antennas comprises an antenna radiator disposed above a ground plane and forming an antenna volume there between, a tuning conductor positioned within the antenna volume, the tuning conductor attached to a first active element for varying a reactance of the antenna; and a steering conductor positioned outside of said antenna volume and adjacent to the antenna radiator, the steering conductor attached to a second active element for varying a current mode thereon. The combining circuit is configured to feed two or more of the antennas in the antenna system simultaneously, providing an array. Multiple antenna beams are formed by selecting combinations of radiation patterns from individual antennas forming the array.

In one embodiment, the combining circuit is capable of selecting two radiation patterns from the antenna array to provide a receive diversity capability. One or both of the radiation patterns can be the resultant pattern from combining two or more antennas in the array.

In another embodiment, the combining circuit is capable of selecting two or more antennas to be used simultaneously for a Multiple Input Multiple Output (MIMO) system. One or more of the radiation patterns can be the resultant pattern from combining two or more antennas in the array.

In another embodiment, a multi-function array is described where several communication system functions are realized using the same antenna architecture. An array of antenna elements where each antenna element can generate multiple radiation patterns is described; the multiple radiation patterns from each antenna element provides increased capability and flexibility in generating a phased array, a MIMO antenna system, a receive diversity antenna system, as well as direction finding feature by way of an interferometer function provided by one or multiple elements. The small volume attributes of the antenna elements populating the array lend this technique to mobile wireless devices as well as access points.

In yet another embodiment, one or more of the antennas is capable of generating two or more unique radiation patterns. The phase of the individual patterns of two or more of the antennas is monitored during reception of an electromagnetic (EM) wave. A look-up table stored in a processor is used to determine the angle of arrival of the incoming EM wave by comparing phase of the received signals from the antennas.

In certain embodiments, a tuning conductor is not required.

The active tuning elements may comprise a switch, FET, MEMS device, or any component that exhibits active capacitive or inductive characteristics such as a tunable capacitor or tunable inductor, or any combination of these components.

We claim:

1. An antenna system, comprising:

a first antenna disposed above a circuit board forming an antenna volume therebetween, a first tuning conductor positioned within said antenna volume, said first tuning conductor coupled with a first active element adapted to vary a reactance thereon, a steering conductor positioned adjacent to the first antenna and outside of said antenna volume, said steering conductor coupled with a second active tuning element adapted to vary a reactance thereon;

a second antenna; and a combining circuit;

said combining circuit configured to feed said first and second antennas simultaneously forming an antenna array;

wherein said antenna system is adapted to form multiple antenna beams by varying antenna patterns of at least one of said first and second antenna.

2. The antenna system of claim 1, wherein said combining circuit is configured to select multiple antenna patterns of the array for providing receive diversity capability.

3. The antenna system of claim 1, wherein said combining circuit is configured to select said first and second antennas for use with multi input multi output functions.

4. The antenna system of claim 1, comprising three or more antennas.

5. The antenna system of claim 1, wherein at least one of said antennas is an active modal antenna adapted to generate two or more independent radiation modes.

6. The antenna system of claim 1, comprising memory containing a lookup table and stored data, wherein phase is monitored for each of said first and second antennas during reception, and a lookup table stored in memory is analyzed to determine an angle of arrival by comparing phase of the received signals.

7. The antenna system of claim 1, wherein said active elements are individually selected from the group consisting of: a switch, FET, MEMs device, tunable capacitor, and a tunable inductor.

* * * * *